US007284360B2

(12) United States Patent
Cary et al.

(10) Patent No.: US 7,284,360 B2
(45) Date of Patent: Oct. 23, 2007

(54) BULK TRANSPORTABLE CONTAINER

(75) Inventors: Randall L. Cary, Battle Creek, MI (US); David C. Ours, Marshall, MI (US); Michael Bauman, Battle Creek, MI (US)

(73) Assignee: Kellogg Company, Battle Creek, MI (US)

( * ) Notice: Subject to any disclaimer, the term of this patent is extended or adjusted under 35 U.S.C. 154(b) by 499 days.

(21) Appl. No.: 10/921,593

(22) Filed: Aug. 19, 2004

(65) Prior Publication Data

US 2006/0037285 A1 Feb. 23, 2006

(51) Int. Cl.
*B65B 11/58* (2006.01)

(52) U.S. Cl. ..... 53/449; 53/439; 53/465; 53/173; 53/210

(58) Field of Classification Search ..... 53/449, 53/465, 436, 439, 527, 528, 170–175, 210, 53/211, 218
See application file for complete search history.

(56) References Cited

U.S. PATENT DOCUMENTS

| | | | | |
|---|---|---|---|---|
| 3,626,654 | A | 12/1971 | Hoffler et al. | 53/26 |
| 4,113,146 | A | 9/1978 | Williamson | |
| 4,253,507 | A | 3/1981 | Williamson | |
| 4,434,603 | A | 3/1984 | Beumer | 53/557 |
| 4,500,001 | A | 2/1985 | Daniels | 206/597 |
| 5,042,235 | A | 8/1991 | Hannen et al. | 53/557 |
| 5,230,689 | A | 7/1993 | Derby | 493/210 |
| 5,544,472 | A | 8/1996 | Koskinen et al. | |
| 5,566,530 | A | 10/1996 | Johnstone et al. | 53/441 |
| 6,012,266 | A | 1/2000 | Koskinen et al. | |
| 6,494,324 | B2 * | 12/2002 | Ours et al. | 206/527 |
| 6,892,768 | B1 * | 5/2005 | Ours et al. | 141/10 |
| 6,918,225 | B2 * | 7/2005 | Ours et al. | 53/139.1 |
| 6,935,385 | B2 * | 8/2005 | Ours et al. | 141/10 |
| 6,945,015 | B2 * | 9/2005 | Ours et al. | 53/442 |
| 2003/0038055 | A1 | 2/2003 | Ours et al. | |
| 2003/0057129 | A1 | 3/2003 | Ours et al. | |
| 2004/0081374 | A1 | 4/2004 | Richardson, Jr. et al. | 383/38 |

FOREIGN PATENT DOCUMENTS

| | | |
|---|---|---|
| DE | 31 15 911 A1 | 11/1982 |
| DE | 101 40 022 A1 | 2/2003 |
| FR | 2 672 873 | 8/1992 |

* cited by examiner

*Primary Examiner*—Hemant M. Desai
(74) *Attorney, Agent, or Firm*—Dickstein Wright PLLC

(57) ABSTRACT

A method for filling a flexible container with a flowable material is provided, including the steps of filling the flexible container, suspending the flexible container, transferring the weight of the flexible container from being suspended to being supported by a support surface, and applying a hoop force to the flexible container to substantially maintain a configuration of the flexible container. The flexible container can be a bag-type container for containing flowable material such as chemicals, food products, agricultural products, and plastic pellets. As the container is lowered from the suspended position to a bottom-supported position, the hoop force is applied around the perimeter as the perimeter changes during transfer of the flexible container from being suspend to being bottom-supported. The hoop force can be applied by stretch wrap. Alternatively, the first flexible container can be lowered into a second flexible container. The second flexible container can be formed from a heat shrinkable material and the second flexible container can be shrunk at the perimeter as the perimeter changes. Alternatively, the second flexible container can be a stretchable bag. A stretched portion of the stretchable bag can be released substantially at the perimeter to generate the hoop force.

12 Claims, 5 Drawing Sheets

BULK TRANSPORTABLE CONTAINER

FIELD OF THE INVENTION

The invention relates to a container configured to hold a plurality of particles and, more specifically, the invention relates to a method for controlling the shape of a flexible container holding a plurality of particles.

DESCRIPTION OF THE RELATED ART

Flowable materials present unique problems with respect to storage, transportation, dispensing, and handling. Examples of flowable materials include agricultural products like seeds, rice, grains, vegetables, fruits; chemical products like fine chemicals, pharmaceuticals, raw chemicals, fertilizers; plastics like plastic resin pellets, plastic parts, rejected plastic parts, machined plastic parts; cereals and cereal products such as wheat; a variety of machined parts of all sorts; wood products like wood chips, landscaping material, peat moss, dirt, sand, gravel, rocks and cement. Products and materials that are bulk packaged also include prepared foods; partially processed foods like frozen fish, frozen chicken, other frozen meats and meat products; manufactured items like textiles, clothing, footwear; toys like plastic toys, plastic half parts, metallic parts, soft toys, stuffed animals, and other toys and toy products.

Flowable material can be transported in substantially rigid shipping containers such as Gaylord boxes. Gaylord boxes are formed in several different sizes; some are approximately two and one-half feet by two and one-half feet and weigh approximately 85 pounds. Such Gaylord boxes can carry approximately 1,100 pounds of flowable material. Flowable materials can also be transported in flexible containers such as bags or sacks. An example of a flexible container for flowable materials is shown in U.S. Pat. No. 4,113,146. Sacks for transporting flowable material are less costly than a Gaylord box. However, sacks are not rigid and tend to distort when placed on a pallet. Distortion of the sack complicates handling of the sack. For example, bulges can be snagged and torn, causing the sack to spill.

FIGS. 1-4 illustrate a bag for transporting flowable materials. A bag 10 for transporting flowable material 12 includes a top 14, a bottom 16, and straps 18, 19, 20, connecting the top 14 and the bottom 16. A plurality of loops 22, 24 can be disposed adjacent the top 14. The loops 22, 24 can be engaged by a transportation device, such as a forklift, for suspending the bag 10. The bag 10 is shown in a suspended position in FIG. 1 without the transportation device for clarity. The bottom 16 can include an inner ring, an outer ring, and loops connecting the inner and outer rings to substantially maintain the shape of the bottom 16 (not shown). The bottom 16 can be connected to the straps 18 and 20 at points 26, 28 respectively. The top 14, bottom 16 and straps 18, 20 are substantially inelastic.

The bag 10 is shown being transferred from a suspended position in FIG. 1, to partially bottom-supported position in FIG. 2, and to fully bottom-supported positions in FIGS. 3 and 4. The distortion of the bag 10 occurs as the weight of the bag 10 is transferred from being suspended at the top 14 to being supported at the bottom 16. Distortion can take the form of overall leaning as is shown in FIG. 3, bulges 19, 19*a* which extend over the edge of the pallet 21, and sags such as sag 23 which drop over the edge of the pallet 21 as shown in FIG. 4. The bag 10 can be substantially cylindrical while suspended as shown in FIG. 1, or box-like, and be irregularly shaped when completely supported at the bottom 16 as shown in FIGS. 3 and 4. FIG. 2 shows an exaggerated bulge 19 occurring when the weight of the bag 12 is beginning to be transferred to a pallet 21. FIG. 3 shows, in exaggeration, the bag 12 leaning after the weight has been transferred to the pallet 21. FIG. 4 shows, in exaggeration, the bag 12 being bottom-supported and defining a bulge 19*a* on one side and a sag 21 on a second side.

SUMMARY OF THE INVENTION

The present invention provides an apparatus and method for controlling a shape of a flexible container which contains a flowable material. The method includes the step of applying a hoop force to the filled, flexible container to at least substantially maintain a shape of the flexible container. The method also contemplates reducing a cross-sectional area of the filled flexible container in some operating environments. The hoop force is applied to the flexible container as the flexible container is transferred from a suspended position to a bottom-supported position. The hoop force is applied at an annular portion of the perimeter, or cross section, of the flexible container and successive annular portions. The hoop force can also be applied to particular cross-sections as the particular cross-section distorts. Alternatively, the hoop force can be applied proactively, before the flexible container distorts. Generally, the position at which distortion occurs rises during the transfer of the filled, flexible container between the suspended position and the bottom-supported position. The hoop force can be generated by a stretch wrap. Alternatively, the filled, flexible container can be lowered into a second flexible container that can apply the hoop force. For example, the filled, flexible container can be lowered into a second flexible container made of heat shrinkable material. The second flexible container can be shrunk along a longitudinal axis of the first flexible container to control the distortion as the weight is transferred. Alternatively, the second flexible container can be a stretchable bag and a stretched portion of the bag can be released as the transfer occurs.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figures 1, 2, 3, 4:
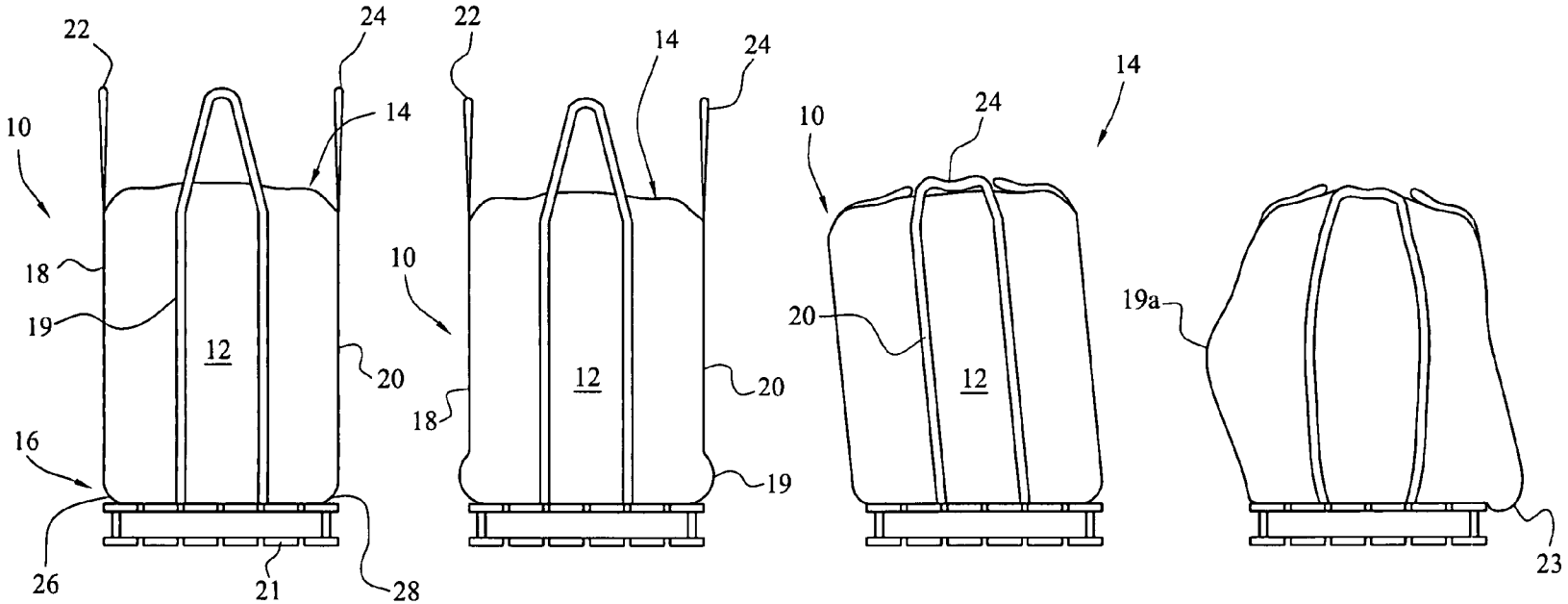
Fig. 4 Prior Art
FIGS. 1-4 illustrate the prior art transfer of a bag filled with flowable material between a suspended position, a bottom-supported position, and a side supported position, showing the bulging and distortion of the bag.

Referring now to FIGS. 5-8, the invention provides a method and apparatus for containing flowable material. The method includes the steps of suspending a first flexible container 10*a* that is filled with flowable material 12*a*. The container 10*a* can be cylindrical or cubic or box-like. The first flexible container 10*a* includes a top 14*a* and a bottom 16*a*. The first flexible container 10*a* is suspended from the top 14*a* while in the suspended position 32. The first flexible container 10*a* also includes a longitudinal axis 42 extending between the top 14*a* and the bottom 16*a*.

A perimeter 17 extends around the axis 42 and defines a cross-sectional area at each position along the axis 42 from the bottom 16*a* to the top 14*a*. The perimeter 17 includes the outer surface of the first flexible container 10*a*, extending from the top 14*a* to the bottom 16*a*. A first configuration of the perimeter is defined when the first flexible container 10*a* is in the suspended position 32. Furthermore, a first configuration of each of a plurality of individual cross-sectional areas disposed along the axis 42 between the bottom 16*a* and the top 14*a* is defined when the flexible container 10*a* is suspended. The first configuration of the perimeter 17 and cross-sections of the exemplary first flexible containers 10*a* would be largely cylindrical.

In the exemplary embodiment of the invention, the first flexible container 10*a* includes straps 18*a*, 20*a* extending between the top 14*a* and the bottom 16*a*. Loops 22*a*, 24*a* are disposed adjacent the top 14*a* for suspending the container 10*a*. The bottom 16*a* is preferably fixedly associated with the straps 18*a*, 20*a* at points 26*a*, 28*a*, respectively.

In cross-section, the first flexible container 10*a* defines a minimized diameter 30 when the first flexible container 10*a* is in the suspended position 32. The first flexible container 10*a* of the exemplary embodiment is cylindrical and so defines a minimized diameter 30. However, in embodiments of the invention wherein the flexible container is cubic or rectangular box-like, container would define minimum width-like and depth-like dimensions. When the bag 10*a* is in the suspended position 32, the straps 18*a*, 20*a* are substantially straight and the cross-section of the container is substantially symmetrical about an axis 42 of the container 10*a*.

The method of the present invention also includes the step of transferring the first flexible container 10*a* from the suspended position 32 to a bottom-supported position 34 in which the first flexible container 10*a* is supported at the bottom 16*a* by a support surface 36. The shape of the perimeter 17 changes in response to the transferring step in the prior art. For example, the first flexible container 10*a* can form a cylindrical shape or a box-like shape when in the suspended position. However, during transfer to the bottom-supported position, the perimeter 17 of the first flexible container 10*a* can distort such as, for example, by bulging, leaning, and sagging. Distortion of the first flexible container 10*a* will occur at successive cross-sections along the axis 42 from the bottom 16*a* to the top 14*a* during the transfer as more and more of the weight becomes bottom-supported. Distorting of the perimeter 17 represent changes in the cross-sections disposed along the axis 42 from the first configuration to a second configuration.

The method also includes the step of incrementally applying a hoop force to the first flexible container 10*a* from the bottom 16*a* to the top 14*a* along the longitudinal axis 42 to at least substantially maintain the first configuration of the cross-sections disposed along the axis 42 during the transferring step. The hoop force is applied adjacent to the portion of the perimeter 17 that exhibits distortion in the form of the second configuration. For example, it may be desirable to allow some distortion in order to identify when and/or where the application of hoop force should commence.

In the exemplary embodiment of the invention, bulging begins at a cross-section adjacent to the bottom 16*a* and application of the hoop force begins adjacent the bottom 16*a* as the transfer begins. The application of the hoop force substantially prevents additional changing of shape of the container 10*a* and the first configuration of the perimeter 17 and the cross-section is substantially maintained.

Figures 5, 6, 7, 8:
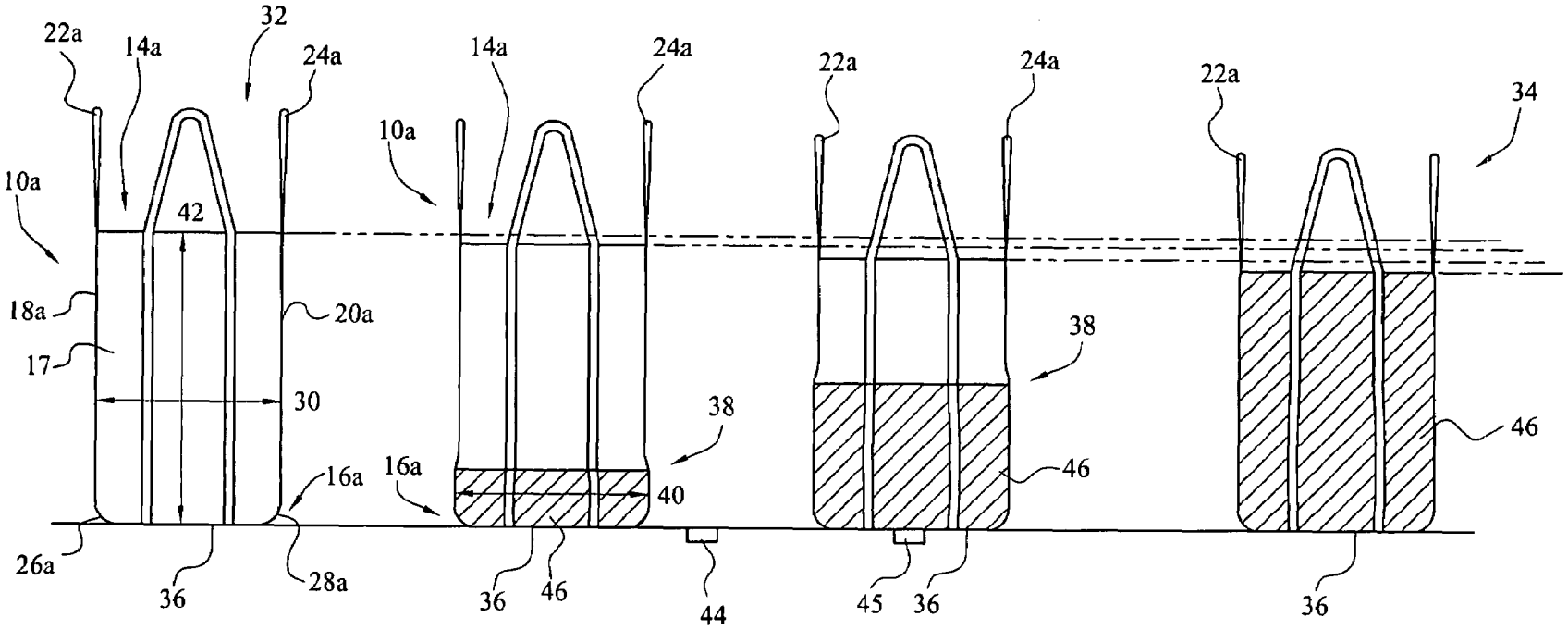
FIGS. 5-8 illustrate the method for substantially reducing bulging of the bag according to the first exemplary embodiment of the invention.

Referring now to FIG. 6, when the container 10*a* is transferred to engage the support surface 36, a portion of the weight of the container 10*a* is received and supported by the surface 36 and a second configuration or bulge level 38 is defined adjacent the bottom 16*a*. The second configuration 38 is a change from the first configuration of the perimeter 17. Preferably, a diameter 40, defined at the second configuration 38, is only slightly greater than the diameter 30. A hoop force is applied to the container 10*a* when the second configuration 38 is first detected or observed. The hoop force is applied incrementally along the axis 42 of the container 10*a* from the bottom 16*a* to the top 14*a* as the entire weight of the filled container 10*a* is transferred from the suspended position 32 to the bottom-supported position 34. In the schematic illustrations of FIGS. 6-8, the hoop forces are applied by a stretch wrap 46.

In an alternative embodiment of the invention, the hoop force is applied as soon as the container 10*a* contacts the surface 36, before a bulge level 38 is defined. This alternative and optional step can be desirable to prevent the container 10*a* from leaning with respect to the support surface 36. This step can also be performed if maintaining a maximum height of the container 10*a* is desired.

The application of the hoop force can be controlled in response to the change in height of the first flexible container as defined by the distance along axis 42 between the top 14*a* and the bottom 16*a* during transfer between the suspended position 32 and the bottom-supported position 34. For example, the invention can include a sensor 44 for sensing the height of the bag as the height changes. The sensor 44 can detect when the distance between the top 14*a* and the bottom 16*a* has changed and the application of the hoop forces can be initiated and/or continued in response to the sensed reduction in height. The reduction in height of the first flexible container 10*a* corresponds to the movement of the first flexible container 10*a* into the second configuration 38. For example, the more the height has been reduced, the greater the first flexible container 10*a* will bulge unless a hoop force is applied. The invention can also include a scale 45 integral with the support surface 36 and the application of hoop forces can be initiated and/or continued in response to the amount of weight supported by the support surface 36. Alternatively, a timing device may be used to coordinate timing of the transferring step with application of the hoop force.

As shown in FIG. 7, after hoop forces have been applied along one or more of the cross-sections of the flexible container 10*a* (adjacent to the bottom 16*a* in FIG. 6), the bulge level 38 may rise, moving from the bottom 16*a* of the container 10*a* in direction of the top 14*a*. Hoop forces are applied to the container 10*a* along the axis 42 from the bottom 16*a* upwardly at a point near the bulge level 38, preferably plus or minus twelve inches from the bulge level 38. However, in some alternative embodiments of the invention, the bulge level may not move. For example, the container 10*a* may be reshaped when wrapped to be pear-like or cone-like.

Figure 9:
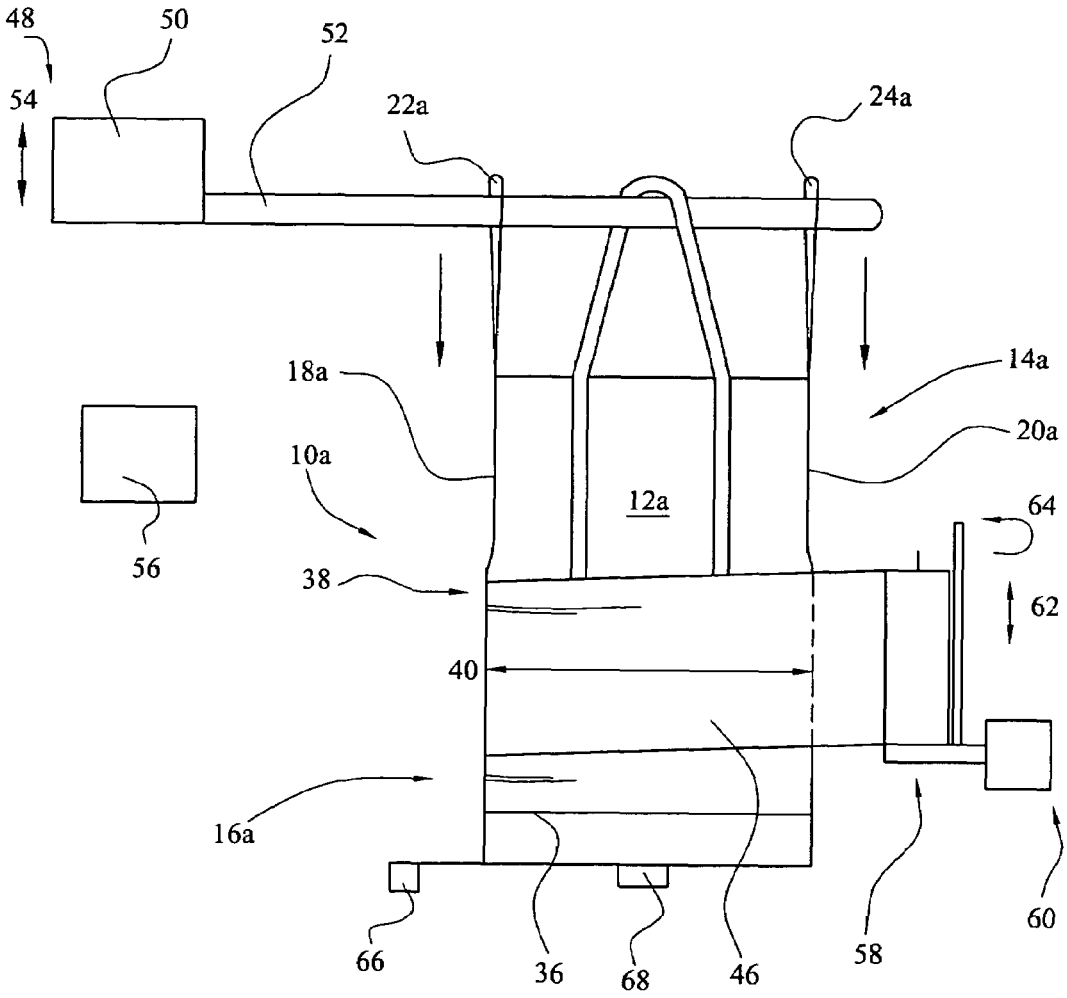
FIG. 9 is a more detailed view of the first exemplary embodiment of the invention shown in FIGS. 5-8.

FIG. 9 is a more detailed view corresponding to the view of FIG. 7. The container 10*a* is filled with flowable material 12*a* and includes a top 14*a*, a bottom 16*a*, and a plurality of straps 18*a*, 20*a* extending between the top 14*a* and the bottom 16*a*. The container 10*a* also includes loops 22*a*, 24*a*. A moving device 48 is schematically shown including a motor 50 and a support member 52. The support member 52 can engage the loops 22*a*, 24*a* and the motor 50 can move the support member 52 along an axis 54 to raise and lower the container 10*a*. The motor 50 can be controlled by a controller 56 to enhance the movement of the container 10*a* from the suspended position, such as position 32 shown in FIG. 5, to the bottom-supported position, such as position 34 shown in FIG. 8.

Stretch wrap 46 is dispensed from a wrap head 58 around the container 10*a* to substantially maintain the diameter 40 and first configuration along the height of the container 10*a* between the top 14*a* and the bottom 16*a*. The wrap head 58 can be supported and moved by a moving device 60. The moving device 60 can move the wrap head 58 vertically along an axis 62 extending parallel to the axis 54. The moving device 60 can also move the wrap head 58 in an angular direction 64, around the container 10*a*. In operation, the wrap head 58 will move along a helical path extending around the container 10*a* and upwardly from the bottom 16*a* to the top 14*a*. In an alternative embodiment of the invention, the container 10*a* can be rotated while the wrap head 58 is moved along the axis 62.

The wrap head 58 moves along the helical path to position stretch wrap 46 adjacent the bulge level 38. More than one layer of stretch wrap 46 can be applied to any particular cross-section during wrapping. For example, a cross-section adjacent the bottom 16*a* can be wrapped more than once before the wrap head is moved upwardly. Additionally, adjacent cross-sections can be wrapped differently. For example, a cross-section adjacent to the bottom 16*a* can be wrapped more than once and a cross-section adjacent to the top 14*a* can be wrapped once. The application of the hoop force to successive cross-sections is controlled by the controller 56 to substantially minimize changes in the first configuration of the perimeter 17 during the transfer of the flexible container 10*a* from being suspended to being bottom-supported.

The controller 56 can control the moving device 60 to enhance the wrapping of the container 10*a*. For example, movement of the wrap head 58 can be controlled by the controller 56 in response to a change in the height of the container 10*a*. The maximum height of the container 10*a*, such as axis 42 shown in FIG. 5, can be programmed into the memory of the controller 56. A sensor 66 can be disposed adjacent a support surface 36 and sense the proximity of the support member 52. When the height of the container 10*a* decreases from the maximum height, wrapping can start by moving the wrap head 58 along a helical path around the container 10*a*. A speed of movement of the wrap head 58 along the helical path can be controlled by the controller 56 in response to a rate of the reduction in height. For example, the more rapidly the container 10*a* is lowered to the bottom-supported position, the quicker the wrap head 58 can be moved along the helical path. Any sensor capable of sensing a distance corresponding to the distance between the top 14*a* and the bottom 16*a* can be used in combination with the present invention.

Alternatively, the movement of the wrap head 58 can be controlled in response to the shifting of weight of the container 10*a* from the support member 52 to the support surface 36. A weight sensor or scale 68 can be operably associated with the support surface 36. The sensor 68 can communicate with the controller 56 and the controller 56 can move the wrap head 58 in response to the signal received from the scale 68. As the weight sensed by the sensor 68 increases, the wrap head 58 can be moved along the helical path. For example, the quicker that the weight of the container 10*a* is transferred to the support surface 36, the quicker the wrap head 58 can move along the helical path.

Alternatively, the movement of the wrap head 58 along the helical path can be controlled by the controller 56 in response to both changes in height and changes in weight. In other words, the controller 56 can move the wrap head 58 in response to conditions sensed by the sensor 66 and conditions sensed by the sensor 68. For example, wrapping can commence when the sensor 68 first detects weight of the container 10*a* and movement of the wrap head 58 along the helical path can be controlled in response to the rate of change of height sensed by the sensor 66.

The method can also include the step of reducing the cross-section. In some operating environments, the flowable material 12*a* and container 10*a* can be compressed by the hoop forces. Generally, if the flowable material 12 defines a high flowability and low density, the container 10*a* can be compressed and reshaped to enhance the transport of the container 12*a*. For example, the container 10*a* can be shaped by the hoop forces to be more cone-like.

Figure 10:
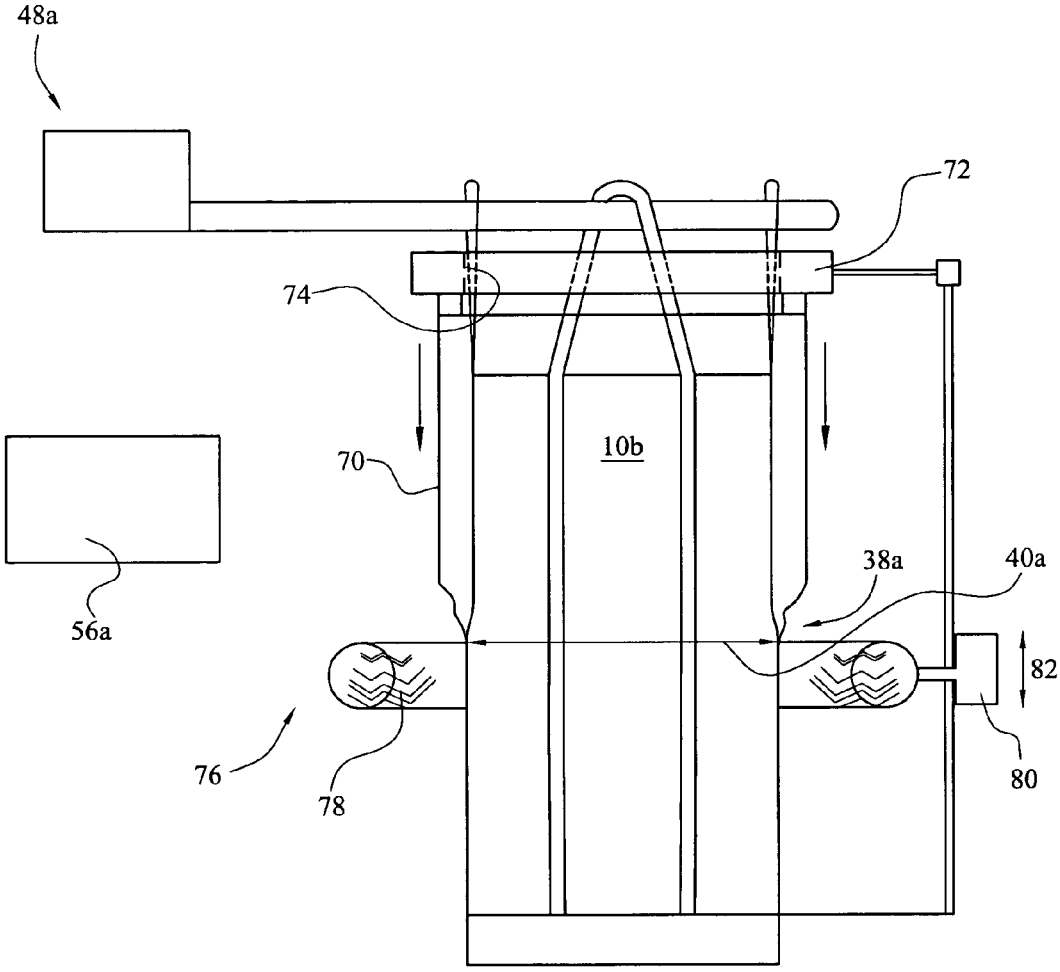
FIG. 10 is a detailed view of a second exemplary embodiment of the invention wherein the filled bag is lowered into a second flexible container formed from heat shrinkable material.
Figure 11:
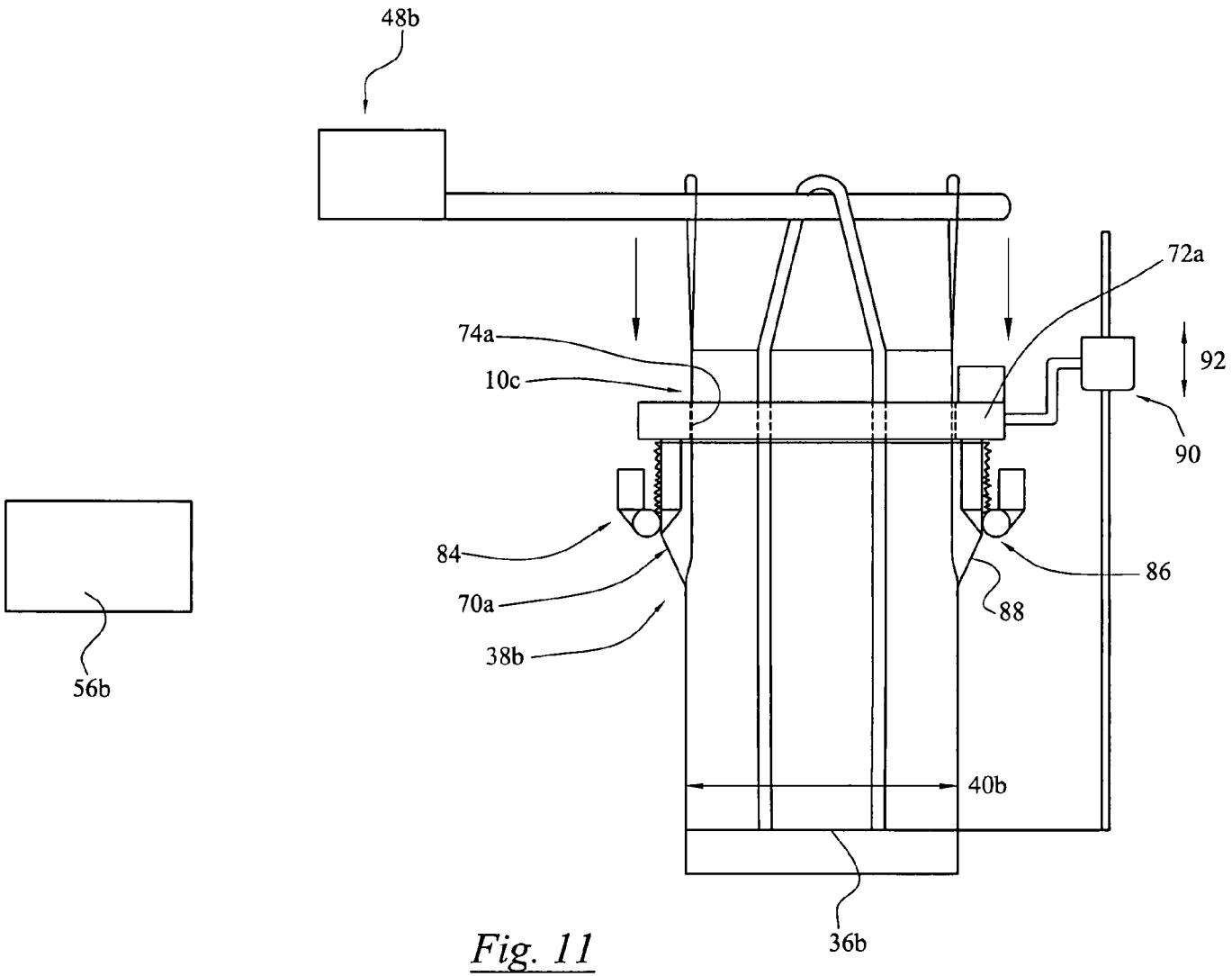
FIG. 11 is a detailed view of a third exemplary embodiment of the invention wherein the filled bag is lowered into a second flexible container formed from stretchable material.

Referring now to FIGS. 10 and 11, the invention can also include moving the flexible container into a second flexible container. The second flexible container can apply the hoop force to the first flexible container to substantially maintain and minimize the diameter of the first flexible container during the transferring step.

Referring now to FIG. 10, a first flexible container 10*b* can be moved with a moving device 48*a* into a second flexible container 70. The second flexible container 70 can be supported by a ring member 72 defining an aperture 74. The first flexible container 10*b* can be lowered into the second flexible container 70 through the aperture 74. The second flexible container 70 can be formed from a heat shrinkable material.

The second exemplary embodiment of the invention includes a heater 76 to direct heat 78 near the second configuration 38*a* to shrink the second flexible container 70. Shrinkage of the second flexible container 70 generates a hoop force at or near the bulge level 38*a* to maintain the diameter 40*a* and the first configuration. A moving device 80 can move the heater 76 along an axis 82 extending parallel to the container 10*b*. A controller 56*a* can control the moving device 80 in response to a change in the height of the container 10*b* or change in the weight supported by the support surface 36*a* in the same manner as set forth more fully above with respect to the first embodiment of the invention.

Referring now to FIG. 11, a first flexible container 10*c* can be moved into a second flexible container 70*a* by a moving device 48*b*. The second flexible container 70*a* can be supported by a ring member 72*a* defining an aperture 74*a*. The moving device 48*b* can lower the first flexible container 10*c* into the second flexible container 70*a* through the aperture 74*a*. The second flexible container 70*a* can be a flexible and resilient bag. The second flexible container 70*a* can be stretched and expanded by the ring member 72*a* and incrementally released by roller members 84, 86. A controller 56*b* can control the roller members 84, 86 to release a stretched portion 88 of the second flexible container 70*a* during the transfer to maintain the diameter 40*b* of the first configuration of the container 10*c*. The ring member 72*a* can be moved with a moving device 90 along an axis 92 extending parallel to the container 10*c*. The controller 56*b* can control the moving device 90 to move the ring member 72*a* along the axis 92 in response to a change in height of the container 10*c* or in response to a change in the weight supported by the support surface 36*b* as set forth more fully above with respect to exemplary embodiment of the invention.

The foregoing invention has been described in accordance with the relevant legal standards and the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method for forming a container containing flowable material comprising the steps of:

providing a flexible container filled with flowable material and having a top and a bottom;

suspending the filled flexible container from the top without supporting the bottom wherein the flexible container also includes a longitudinal axis extending between the top and the bottom, the flexible container also defining a plurality of cross-sections around the longitudinal axis and wherein each of the plurality of cross-sections has a first configuration when the filled, flexible container is suspended;

transferring a weight of the filled flexible container from being suspended at the top without supporting the bottom to being supported at the bottom by a support surface; and incrementally applying a hoop force to the flexible container from the bottom to the top along at least a portion of the longitudinal axis to at least substantially maintain and/or reduce the cross-sections disposed along the portion of the longitudinal axis during the transferring of the filled flexible container from being suspended at the top without supporting the bottom to being supported at the bottom by the support surface.

2. The method of claim 1 wherein said incrementally applying step is further defined as applying the hoop force to the cross-sections disposed along the portion of the longitudinal axis when the cross-sections change from the first configuration to a second configuration during the transferring step.

3. The method of claim 1 wherein said incrementally applying step includes wrapping the flexible container with stretch wrap to generate the hoop force.

4. The method of claim 3 wherein said wrapping step is further defined as wrapping the flexible container at successive positions along the longitudinal axis from the bottom to the top in response to changes in the respective configurations of the cross-sections from the first configuration to a second configuration.

5. The method of claim 1 further comprising the step of securing the flexible container to a pallet.

6. The method of claim 1 further comprising the step of securing the flexible container to a slip sheet.

7. The method of claim 1 further comprising the step of securing the flexible container to a pallet and a slip sheet.

8. The method of claim 1 wherein said incrementally applying step includes moving the flexible container into a second flexible container during the transferring step.

9. The method of claim 8 wherein said transferring step is further defined as lowering the filled flexible container into a heat shrinkable second flexible container during the transferring step.

10. The method of claim 9 wherein said incrementally applying step includes directing heat to the second flexible container adjacent to successive portions of the pluralities of cross-sections from the bottom to the top in response to respective changes in each of the successive portions from the first configuration to a second configuration.

11. The method of claim 10 wherein said transferring step is further defined as lowering the first flexible container into a stretchable second flexible container during the transferring step.

12. The method of claim 11 wherein said incrementally applying step includes stretching the second flexible container before the lowering step and releasing a stretched portion of the second flexible container adjacent to successive portions of the pluralities of cross-sections from the bottom to the top in response to respective changes in each of the successive portions from the first configuration to the second configuration.

* * * * *